US005617729A

United States Patent [19]

Hyman

[11] Patent Number: 5,617,729

[45] Date of Patent: Apr. 8, 1997

[54] CENTRAL AIR CONDITION UTILITY SYSTEM AND METHOD OF OPERATION THEREOF

[76] Inventor: Curtis Hyman, 3922 Knotty Oaks, Houston, Tex. 77045

[21] Appl. No.: 641,284

[22] Filed: Apr. 30, 1996

[51] Int. Cl.[6] ..... F25B 5/02

[52] U.S. Cl. ..... 62/117; 62/175; 62/260

[58] Field of Search ..... 62/175, 117, 260, 62/259.1, 524, 525, 199, 200; 165/207, 45, 47, 48.1

[56] References Cited

U.S. PATENT DOCUMENTS

| | | | |
|---|---|---|---|
| 431,502 | 7/1890 | Armstrong | 62/260 X |
| 3,425,485 | 2/1969 | Newton | 165/22 |
| 3,817,159 | 6/1974 | Bennett | 98/334 |
| 3,948,060 | 4/1976 | Gaspard | 62/175 |
| 4,495,781 | 1/1985 | Gatling | 62/260 |
| 4,932,220 | 6/1990 | Inoue | 62/175 |
| 5,142,877 | 9/1992 | Shimizu | 62/200 X |
| 5,467,604 | 11/1995 | Sekigami et al. | 62/117 |

*Primary Examiner*—Harry B. Tanner
*Attorney, Agent, or Firm*—Maryam Bani-Jamali

[57] ABSTRACT

This invention presents an air condition utility system for providing air condition to sets of buildings, with each building having a number of amended air conditioning systems, by repeatedly circulating a refrigerant in a closed loop. Each station is connected to an assigned set of buildings of a district by high-pressure lines and low-pressure lines. High-pressure lines are used to transfer the refrigerant, in a liquid stage, from a station to each building that is served by the station. Upon providing air condition to a building, the refrigerant loses pressure and returns in a partial-gas partial-liquid stage through downwardly-sloped low-pressure lines from the building to the station. In the station, the refrigerant is pressurized by passing through a number of compressor units and again leaves the station in a liquid form through the high-pressure lines.

17 Claims, 9 Drawing Sheets

CENTRAL AIR CONDITION UTILITY SYSTEM AND METHOD OF OPERATION THEREOF

BACKGROUND OF THE INVENTION

1. Field of the Invention

This invention relates to a system, as well as method of operation thereof, for providing air condition utility to buildings throughout districts using an assigned station per district for circulating refrigerant to and from each building while deleting any need for self-contained condensing units by buildings.

2. Description of the Prior Art

Any discussion of a system for providing air condition utility from a station to a number of locations arouses several major issues.

Obviously, required expenses are among the primary issues that appear. Usually, expenses for presently-used air conditioning systems are high and unnecessary. A main contributor to expenses for presently-used air conditioning systems is a self-contained condensing unit which is frequently positioned on roofs of buildings. Said self-contained condensing unit conditions air through a network of ducts and, using some air distribution means, distributes the conditioned air to a plurality of chambers or zones. A version of a frequently used self-contained condensing unit is a terminal fan coil unit which is generally positioned in a wall of a room or of a zone to be provided with conditioned air. Said terminal fan coil is adapted to withdraw "used" air (or secondary air) from the room or zone for further conditioning prior to being recirculated upon mixing with fresh or primary air.

An attempt to reduce cost of installing, repairing and replacing self-contained condensing units and to expand the field of application of said units has resulted in an increase in popularity of ducted cooling systems using ducted incremental units. As a result, unit air conditioners are presently each installed at a single location with ducts extending laterally to remote locations in order to provide more uniform and effective air conditioning in a number of zones. A disadvantage of said existing ducted cooling systems is due to withdrawal of return air from the cooled room or region at the condensing unit only. The return air withdrawal requires greater air induction in the vicinity of the condensing unit, causing draughty conditions within the cooled room or region. In addition to requiring substantially increased labor costs for fabrication and installation of separate supply and return air ducts, the existing ducted cooling systems require costly modifications of their central air condensing unit and terminal fan coil units in each room or region to be air conditioned.

Various types of systems for distribution of fluids and/or aiming at cooling have been developed in the past. However, due to high costs and lack of efficiency, these systems have not been capable of providing air condition utility for a populated area.

Gatling, U.S. Pat. No. 4,495,781, issued on Jan. 29, 1985, patents an underground air cooling system for at least one building. The cooling system includes an air line disposed beneath the ground for conveying air to an I-tank having an upper and a lower compartment. A fluid filling the lower compartment of the I-tank absorbs heat from the air in the air line and dissipates that heat quickly to the surrounding earth and to the fluid in the upper compartment of the I-tank. Also, a fluid line is connected to the I-tank and is interposed in the path of the air in the air line. Cold water from the I-tank runs through the water line. When air passes over the fluid line in the air line, the air is cooled and dehumidified before reaching a building.

Bennett, U.S. Pat. No. 3,817,159, issued on Jun. 18, 1974, patents a ducted air conditioning system for providing conditioned air to a plurality of zones and a combination duct for the system. A combination supply and return air duct connects the fan coil unit of either an incremental air conditioner or a central system with each of the zones to be supplied with conditioned air. The combination duct forms supply and return air sections that are almost completely sealed from each other. Each section has a plurality of openings connecting the section to the surrounding environment. The return air section communicates with the fan coil unit for recycling of the return air to the unit.

Newton, U.S. Pat. No. 3,425,485, registered on Feb. 4, 1969, discusses an air conditioning unit and pump for single pipe system. The water supplied to the units is circulated through a heat exchanger in the air handling units by means of a pump which is intermittently operated. The pump operates only if the room requires cooling and chilled water is available and when the room requires heating and heated water is available.

The above-listed systems and many other distribution systems exist in different industries. However, few of these systems are capable of distributing air condition utility to buildings throughout a district using a station for circulating refrigerant to and from each building. A cooling system, as well as method of operation thereof, is described herein that provides air conditioning to buildings and deletes any need for individual condensing units.

SUMMARY OF THE INVENTION

A primary object of the invention is to devise a central air condition utility system for circulating refrigerant from a station to buildings of a district through high-pressure lines and from the buildings of the district to the station through low-pressure lines.

Another object of this invention is to devise an improved air conditioning system which eliminates requirement for separate and costly self-contained condensing units without requiring any modification in internal systems of presently-used air conditioning systems.

A final object of this invention is to provide an improved air conditioning system that, in comparison with existing air conditioning systems which have self-contained condensing units, is more efficient, easier to operate and to maintain, less costly and more environmentally friendly.

Additional objects and advantages of the invention will be set forth in part in a detailed description which follows, and in part will be obvious from the description, or may be learned by practice of the invention.

In general, the present invention has been developed against the above background to provide application of a central air condition utility system for buildings. The central air condition utility system is a means for providing air condition to an entire community just as a local lighting and power company provides electricity to the community. A refrigerant is circulated through high-pressure lines from a station to buildings of an assigned district and through low-pressure lines from the buildings of the assigned district to the station. The high-pressure lines and the low-pressure lines form a closed loop. With the buildings being part of the closed loop, a number of amended air conditioning systems of the buildings would operate without any modifications other than removal of self-contained condensing units of the buildings.

It is to be understood that the descriptions of this invention are exemplary and explanatory, but are not restrictive, of the invention. Other objects and advantages of this invention will become apparent from the following specification and from any accompanying charts, tables, examples and drawings.

BRIEF DESCRIPTION OF CHARTS, TABLES, EXAMPLES AND DRAWINGS

Any accompanying charts, tables, examples and drawings which are incorporated in and constitute a part of this specification, illustrate examples of preferred embodiments of the invention and, along with the description, serve to explain the principles of the invention.

DETAILED DESCRIPTION OF THE PREFERRED EMBODIMENT

Figure 1:
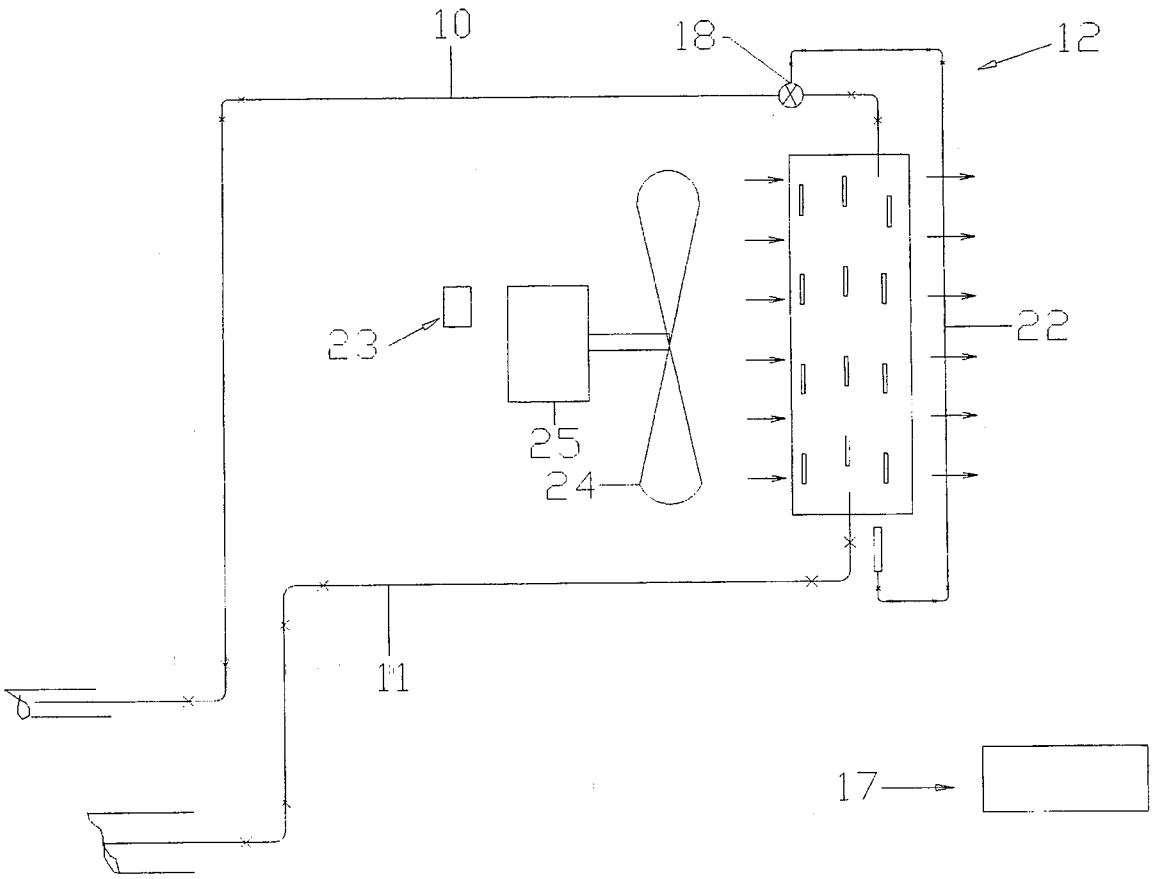
FIG. 1 is a schematic view of an amended air conditioning system of a building.
Figure 2:
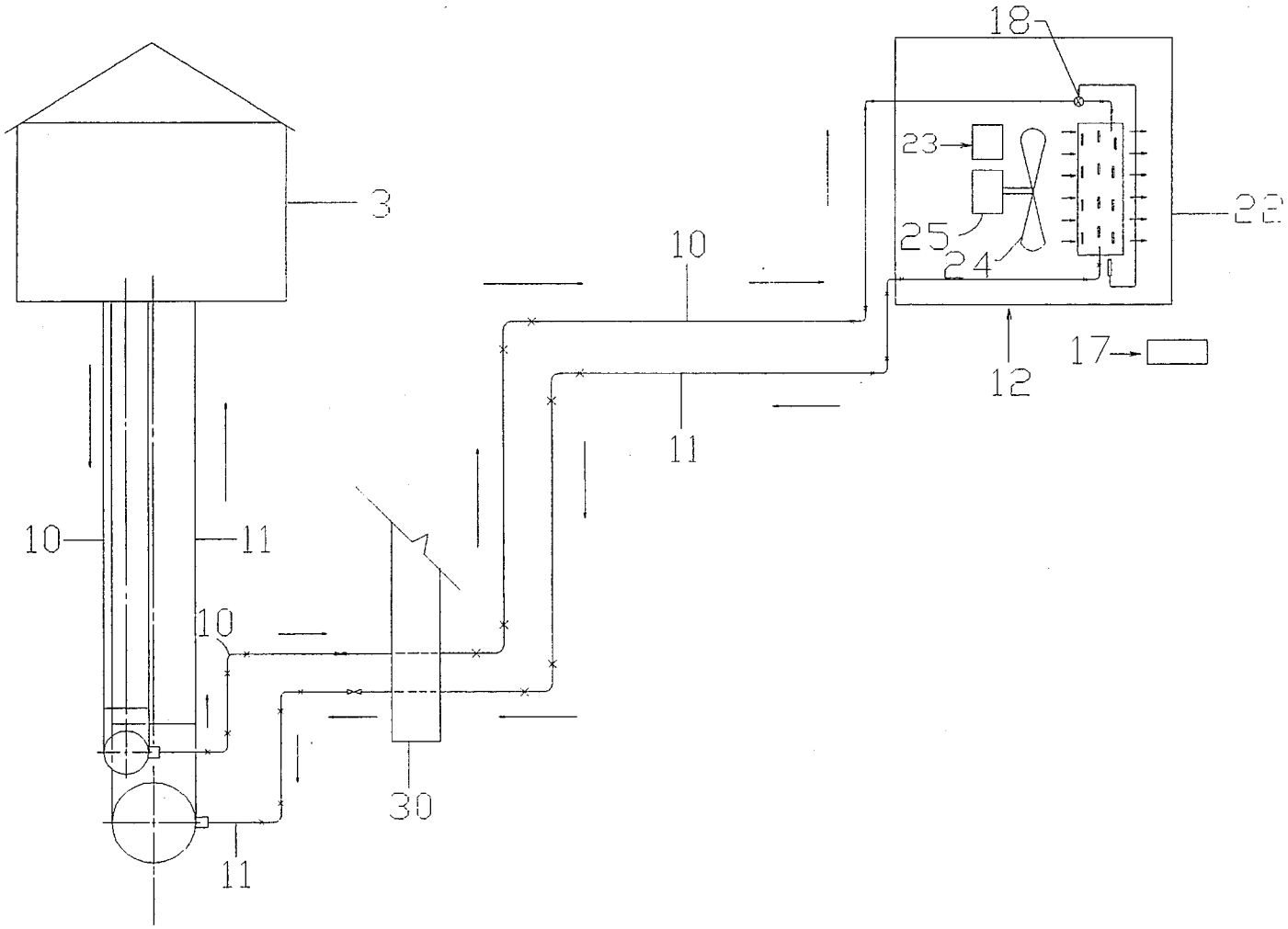
FIG. 2 is a schematic view of the amended air conditioning system of FIG. 1, showing connections of the building having the amended air conditioning system to an assigned station of a central air condition utility system.

Preferred embodiments of the present invention are illustrated in any charts, tables, examples and drawings that follow.

The present invention provides a new central air condition utility system 1 (as shown in FIG. 2, FIG. 4, FIG. 5A and FIG. 6) for buildings 30, particularly for business and residential units. The central air condition utility system 1 uses a number of stations 3 in order to provide air condition utility to a community. Each station 3 provides air condition to buildings 30 throughout an assigned district. High-pressure lines 10 distribute a refrigerant from the station 3 to the buildings 30 of the district served by the station 3. Low-pressure lines 11 return the refrigerant from the buildings 30 of the district served by the station 3 to the station 3. The high-pressure lines 10 and the low-pressure lines 11 form a closed loop through which varying loads of refrigerant are circulated.

Capacity of each station 3 is based upon the population of the district served by the station 3 and upon the air condition load that is needed in the district. A number of amended air conditioning systems 12 (with any self-contained condensing units, and any related sections, of presently-used air conditioning systems removed) exists in each building 30 served by the station 3. A number of amended air conditioning systems 12 of thousands of buildings 30 may be connected, via the building 30 assigned to each amended air conditioning system 12, to one station 3 which may be in turn interconnected directly or indirectly to a number of other stations 3. (Please refer to FIG. 6.) The interconnections among the stations 3 and the buildings 30 are the essence of the central air condition utility system 1. The interconnections create contact between each building 30 and the corresponding station 3. The station 3 circulates through the district the quantity of refrigerant that is needed by the assigned buildings 30, provides any proper refrigerant pressures to satisfy needs of any amended air conditioning systems 12 of each building 30 and provides time, date, identification and system status. Each station 3 is set up to handle a maximum amount of air condition at any moment.

The central air condition utility system 1 circulates refrigerant through high-pressure lines 10 (i.e. liquid lines), and low-pressure lines 11 (i.e. suction lines). R22 monochlorodifluoromethane ($CHCLF_2$) is an example of refrigerants that are used in the central air condition utility system 1. The high-pressure lines 10 and the low-pressure lines 11 of refrigerant are substantially located underground and connect each station 3 to the corresponding buildings 30. The number of amended air conditioning systems 12 of each building 30 may be connected, via the building 30, to the assigned station 3 without any modifications other than removal of the self-contained condensing units of the presently-used air conditioning systems of the building 30. (Please compare FIG. 1 and FIG. 2.) As a rule, the central air condition utility system 1 does not necessitate any changes in the internal air condition system of any building 30. Only a few types of air condition systems, such as gas unit or unitary systems which require modifications of their interior air handlers and evaporator coils, create exceptions to the rule. Existing self-contained condensing units (which are located outside the building 30) of the presently-used air conditioning systems of buildings 30 are disconnected and removed by a service person of any air conditioning utility company, preferably at no cost to owner of the building 30. Removal of the self-contained condensing units is accompanied by several advantages to the owners of the self-contained condensing units. The removal of the self-contained condensing unit eliminates maintenance of the most expensive part of the presently-used air conditioning systems, resulting in a decrease in expenses for the owner of the building 30. In addition, a need for replacement of each self-contained condensing unit every ten to fifteen years is deleted. The area presently occupied by the self-contained condensing units may be used for other purposes. Loss of the self-contained condensing units due to theft is eliminated. The noise level of the self-contained condensing units is eliminated. In addition, deletion of the self-contained condensing units from the presently-used air conditioning system has positive environmental effects. Multiple required changings of the self-contained condensing units result in escape of residual amounts of refrigerant remaining in each self-contained condensing unit into the atmosphere. Utilization of the central air condition utility system 1 greatly reduces amount of refrigerant that escapes into the atmosphere during each changing of the self-contained condensing units.

Figure 3:
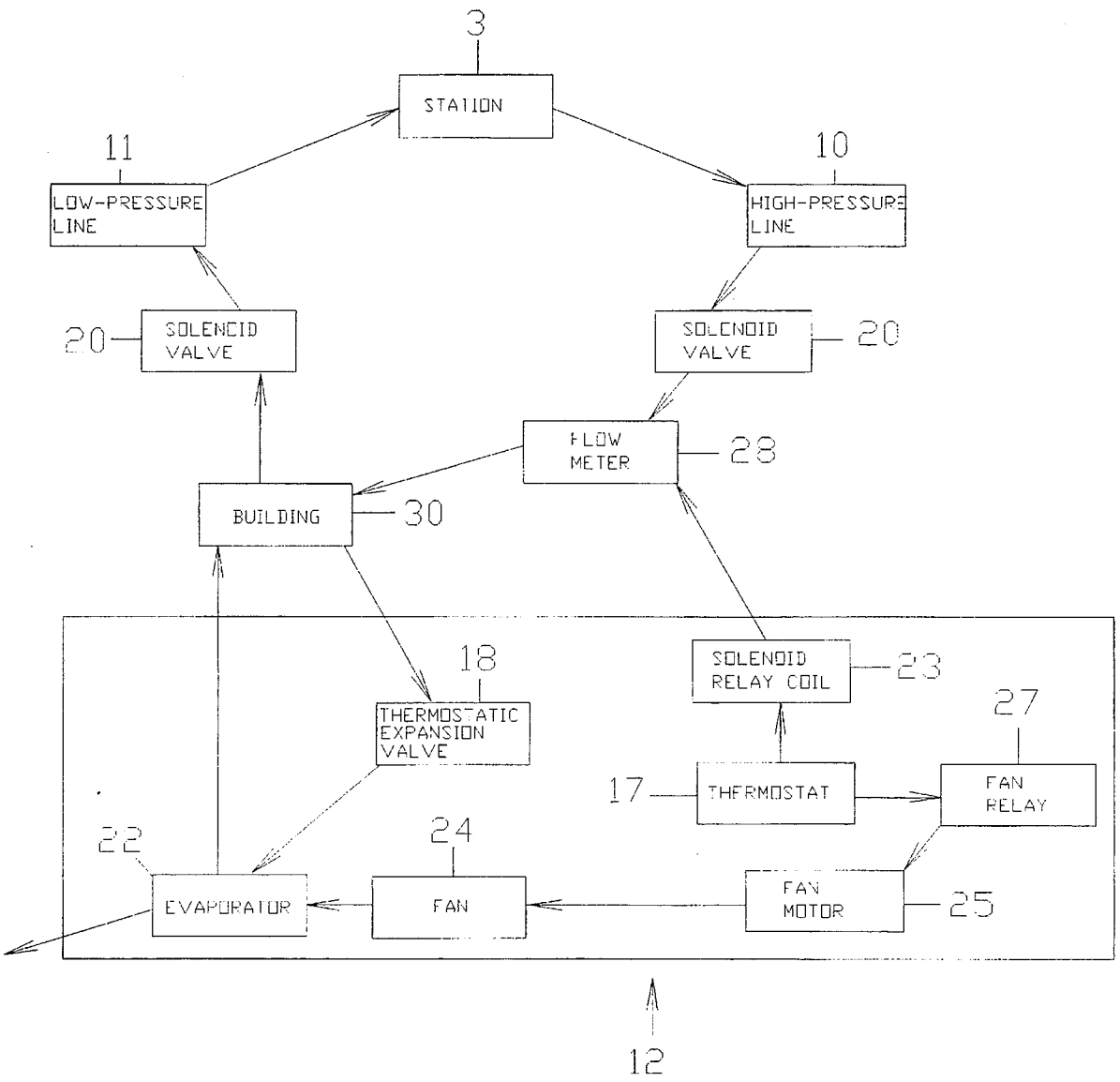
FIG. 3 is a block diagram of the amended air conditioning system of FIG. 2, showing interconnections between the assigned station of the central air condition utility system and, via the building, major components of the amended air conditioning system.

The station 3 and the high-pressure lines 10 and the low-pressure lines 11 of the station 3 substitute for the removed self-contained condensing units and are connected to the buildings 30 in which continuations of the high-pressure lines 10 and of the low-pressure lines 11 lead to the amended air conditioning systems 12. Amended air conditioning systems 12, which comprise thermostats 17, thermostatic expansion valves 18 (or capillary tubes), and evaporators 22, of the buildings 30 are not changed and are connected to high-pressure lines 10 entering the buildings 30 and low-pressure lines 11 leaving the buildings 30. (Please refer to FIG. 1, FIG. 2 and FIG. 3.) The amended air conditioning system 12 of each building 30 continues to operate exactly as before removal of the self-contained condensing unit without any modifications. The demand for cooling of each amended air conditioning system 12 continues to be controlled from the thermostat 17. The high-pressure lines 10 and the low-pressure lines 11 of refrigerant are equipped with solenoid valves 20. When the thermostat 17 demands cooling, the voltage of the thermostat 17 opens solenoid valves 20 assigned to the building 30. Said voltage of the thermostat 17 of the amended air conditioning system 12 preferably ranges from approximately 24 vac to approximately 32 vac (between approximately 35 ma and approximately 45 ma). The thermostat 17 provides power to a solenoid relay coil 23 causing the contact to close, enables the solenoid valves 20 to open and allows the high-pressure liquid refrigerant to flow and to be transferred from the station 3 to the building 30. The liquid refrigerant flows through the solenoid valve 20, through a flow meter 28 and through the thermostatic expansion valve 18 into the assigned evaporator 22, allowing the evaporator 22 to obtain the necessary cooling until a demand for cooling no longer exists. (Please refer to FIG. 3.) When the demand for cooling terminates, the thermostat 17 switches the power from the solenoid relay coil 23, causing the contacts to open, allowing the solenoid valve 20 to return to the closed position and terminating the flow of refrigerant through the evaporator 22. The refrigerant, which causes cooling of the evaporator 22, is originally in a liquid form when leaving the station 3 but undergoes a drop in pressure upon entering into the evaporator 22 and is changed into a partial-liquid partial-gas mixture when being returned to the station 3. Simultaneously, changes in the thermostat 17 cause a fan relay 27 to be closed, triggering a fan motor 25 to force air through a fan 24 across the evaporator 22 until the temperature that is set on the thermostat 17 is reached. (Please refer to FIG. 1, FIG. 2 and FIG. 3)

Each station 3 is equipped with a number of compressor units 4 connected to an inlet manifold 5 allowing the station 3 to have a single input of the refrigerant from main low-pressure lines 11 (i.e. low-pressure lines 11 that are directly connected to the station 3) and to an outlet manifold 6 allowing the station 3 to have a single output of the refrigerant to main high-pressure lines 10 (i.e. high-pressure lines 10 that are directly connected to the station 3). (Please refer to FIG. 5A.) The number of compressor units 4 transfer the refrigerant from the inlet manifold 5 to the outlet manifold 6. The number of compressor units 4 are set up to have a number of compressor units 4 on line, with any remaining compressor units 4 being kept in reserve. Thus, some compressor units 4 can be pulled off line for maintenance without causing any interruption in the flow of refrigerant.

The central air condition utility system 1 operates in a closed loop such that the refrigerant is transferred through the number of compressor units 4 at the station 3. The refrigerant is distributed via the high-pressure lines 10 from the station 3 to each building 30 served by the station 3. The refrigerant is then returned to the station 3 via the low-pressure lines 11 and, upon passing through the number of compressor units 4 of the station 3 that are on line, is circulated through the high-pressure lines 10. (Please refer to FIG. 2, FIG. 3 and FIG. 5A.) This circulation continues repeatedly.

Meanwhile, interconnections among different stations 3 make flow of refrigerant possible if any stations 3 fail to function properly. (Please refer to FIG. 6.) Each station 3 is equipped with control sensors 7 (not shown) and shut-off valves 8, preferably manual shut-off valves 8, to allow isolation of a station 3 from other stations 3 and to allow connection of the station 3 to other stations 3 when required. At least one control sensor 7 is attached to the high-pressure lines 10 and at least one control sensor 7 is attached to the low-pressure lines 11 of each station 3. Upon receipt of signals indicating a need for isolation of a station 3, operators of the stations 3 could use shut-off valves 8, which are connected to the high-pressure lines 10 and to the low-pressure lines 11 of each station, in order to divert the refrigerant around an inoperative or malfunctioning station 3. In addition, different sections of any district may be isolated from the station 3 that provides air condition to the district. As a result, any buildings 30 that are not directly affected may continue to use the central air condition utility system 1. The refrigerant may also be similarly diverted if demand for refrigerant increases in other stations 3.

The air conditioning utility company circulates refrigerant through the high-pressure lines 10 from the station 3 and through the low-pressure lines 11 towards the station 3 based on the air condition load required for the assigned district or until the station 3 has reached its maximum cooling capacity. There is an allowance for potential increase in air conditioning needs in each district. A potential growth of approximately twenty-five percent is allowed in the air conditioning capacity for the district served by the station 3. For determining the air conditioning capacity of the district, calculations would include needs of any additional buildings 30 that could be accepted by the district and any potential increases in population of the district.

Each station 3 provides refrigerant, by the high-pressure lines 10, to each assigned building 30 at a pressure in the range of about 275 Pounds Per Square Inch Gauge (PSIG) to about 300 PSIG. The pressure of the refrigerant is in the range of about 65 PSIG to about 75 PSIG when the refrigerant leaves the building 30 through the low-pressure line 11. The difference in pressure between the high-pressure line 10 and the low-pressure line 11 of the refrigerant shall be at least about 197 PSIG. Said difference in pressure of the refrigerant is measured between the high-pressure line 10 and the low-pressure line 11 at interface of the building 30.

Figure 5A:
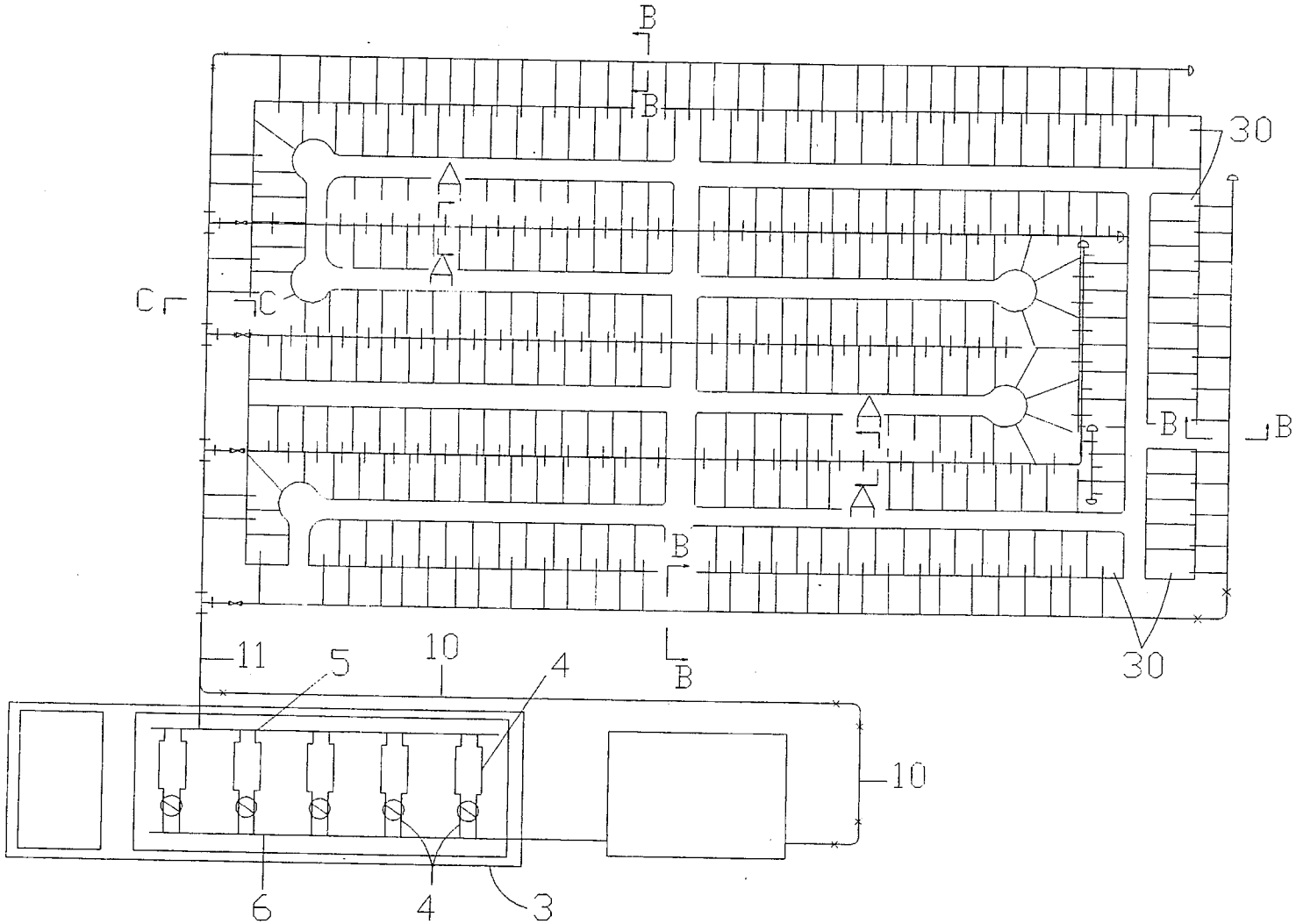
FIG. 5A is a schematic view of a central air condition utility system, with various forms of interconnections between buildings of a district and an assigned station being shown and with some sections of the station being presented.
Figure 5B:
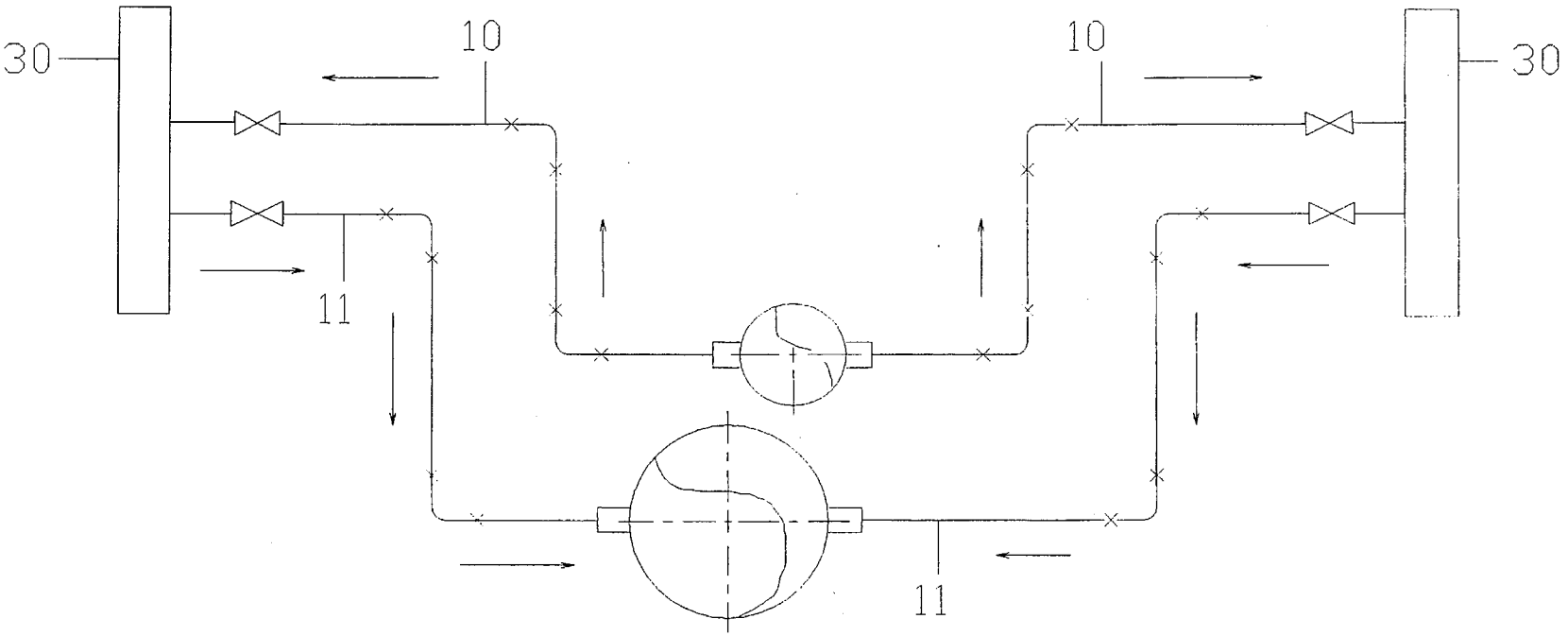
FIG. 5B is an enlarged, detailed schematic view of Section A—A of the central air condition utility system of FIG. 5A.
Figure 5C:
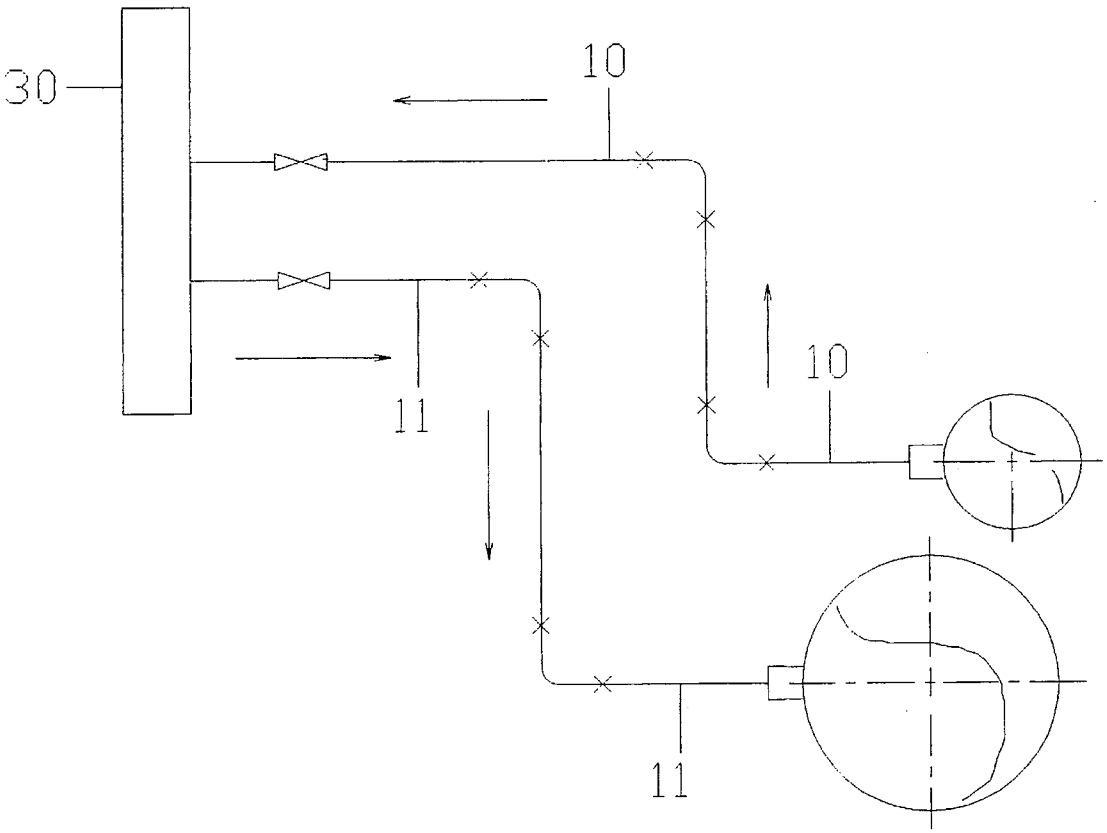
FIG. 5C is an enlarged, detailed schematic view of Section B—B of the central air condition utility system of FIG. 5A.
Figure 5D:
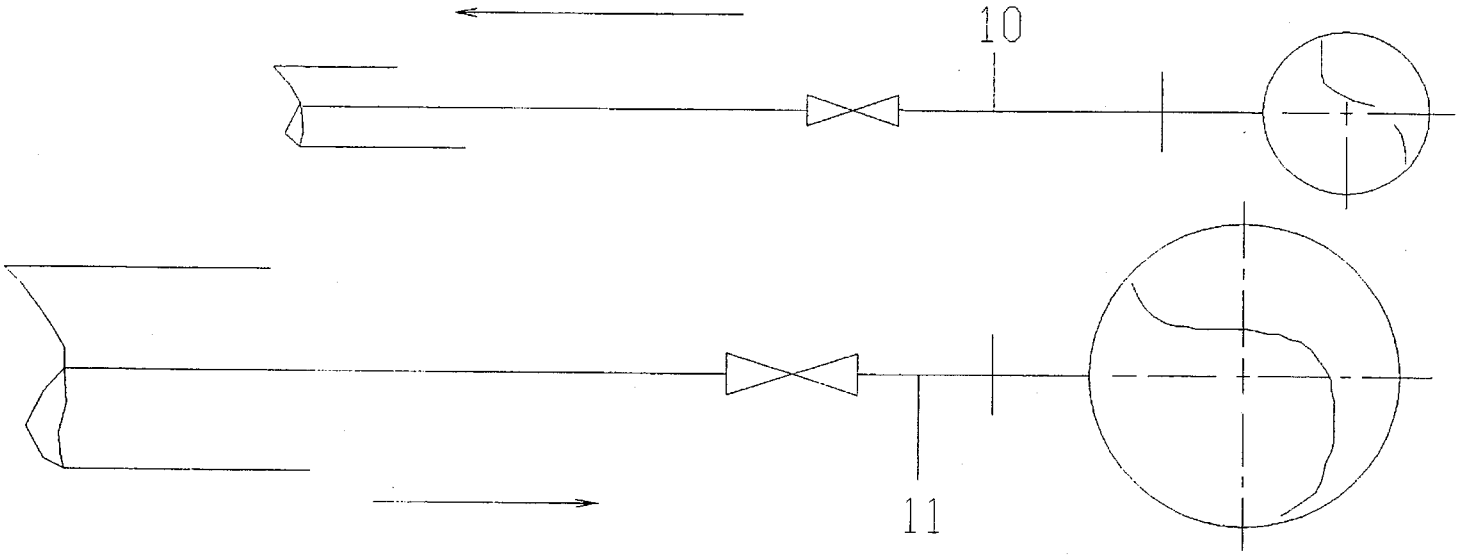
FIG. 5D is an enlarged, detailed schematic view of Section C—C of the central air condition utility system of FIG. 5A.
Figure 6:
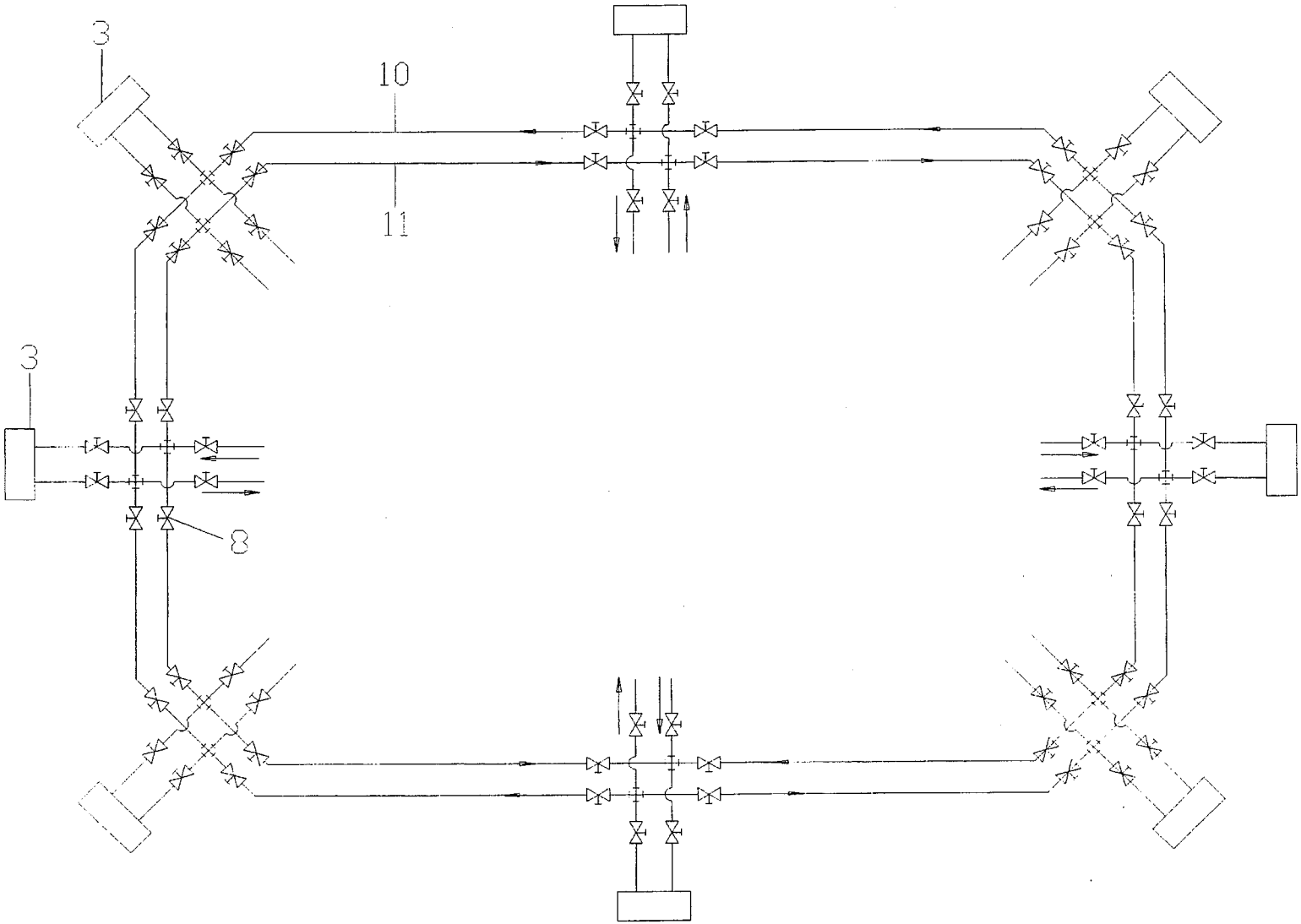
FIG. 6 is a schematic view of a central air condition utility system showing interconnections of stations among themselves and showing shut-off valves for isolating an inoperative portion of high-pressure lines and of low-pressure lines of the stations.

Each station 3 is located strategically to be able to serve the corresponding district, with high-pressure lines 10 and low-pressure lines 11 forming a closed loop in each district and with high-pressure lines 10 going towards and low-pressure lines 11 moving away from each building 30. In some cases, a portion of the high-pressure line 10 of the refrigerant splits into several branches, with each branch providing high-pressure line 10 of refrigerant to one assigned building 30 despite the number of amended air conditioning systems 12 in each building 30. Upon exit of each branch from the assigned building 30, the branches join one another at an identical portion of the low-pressure line 11. For example, a portion of the high-pressure line 10, by being split into two branches, feeds two buildings 30. One branch of the high-pressure line 10 supplies refrigerant to an assigned building 30 and the other branch of the high-pressure line 11 supplies refrigerant to another building 30, despite the number of amended air conditioning systems 12 in each building 30. In each building 30, the refrigerant would be divided among individual amended air conditioning systems 12 in the building 30. When leaving the assigned building 30, the two branches join one another at an identical portion of the low-pressure line 11, as shown in FIG. 5B, Section "A—A". In other cases, a portion of the high-pressure line 10 of the refrigerant moves, without being split into branches, towards one assigned building 30 only and the low-pressure line 11 of the refrigerant leaves the assigned building 30 to join a portion of the low-pressure line 11 that is not shared by any other buildings 30, as shown in FIG. 5C, Section "B—B". In addition, there are examples wherein a portion of the high-pressure line 10 of the refrigerant flows directly from the station 3 and a portion of the low-pressure line 11 of the refrigerant flows directly to the station 3. (Please refer to Section "C—C" of FIG. 5D.) The high-pressure lines 10 and the low-pressure lines 11 of refrigerant of a section of the district have a size and a capacity that are based upon the amount of air condition needed in the district, upon the population of the district and upon needs of individual buildings 30 of the district. The main high-pressure line 10 leaving the station 3 and the main low-pressure line 11 approaching the station 3 each has a specific capacity (i.e. line capacity). The main high-pressure line 10 leaving the station 3 is divided into subsidiary high-pressure lines 10 in the district. Repeating divisions of each high-pressure line 10 in the district result in decreasing line capacities in the divided high-pressure lines 10. Conversely, the individual low-pressure lines 11 leaving a set of buildings 30 in the district join. Repeating combinations of sets of low-pressure lines 11 yield increasing capacities in the combined low-pressure lines 11.

Figure 4:
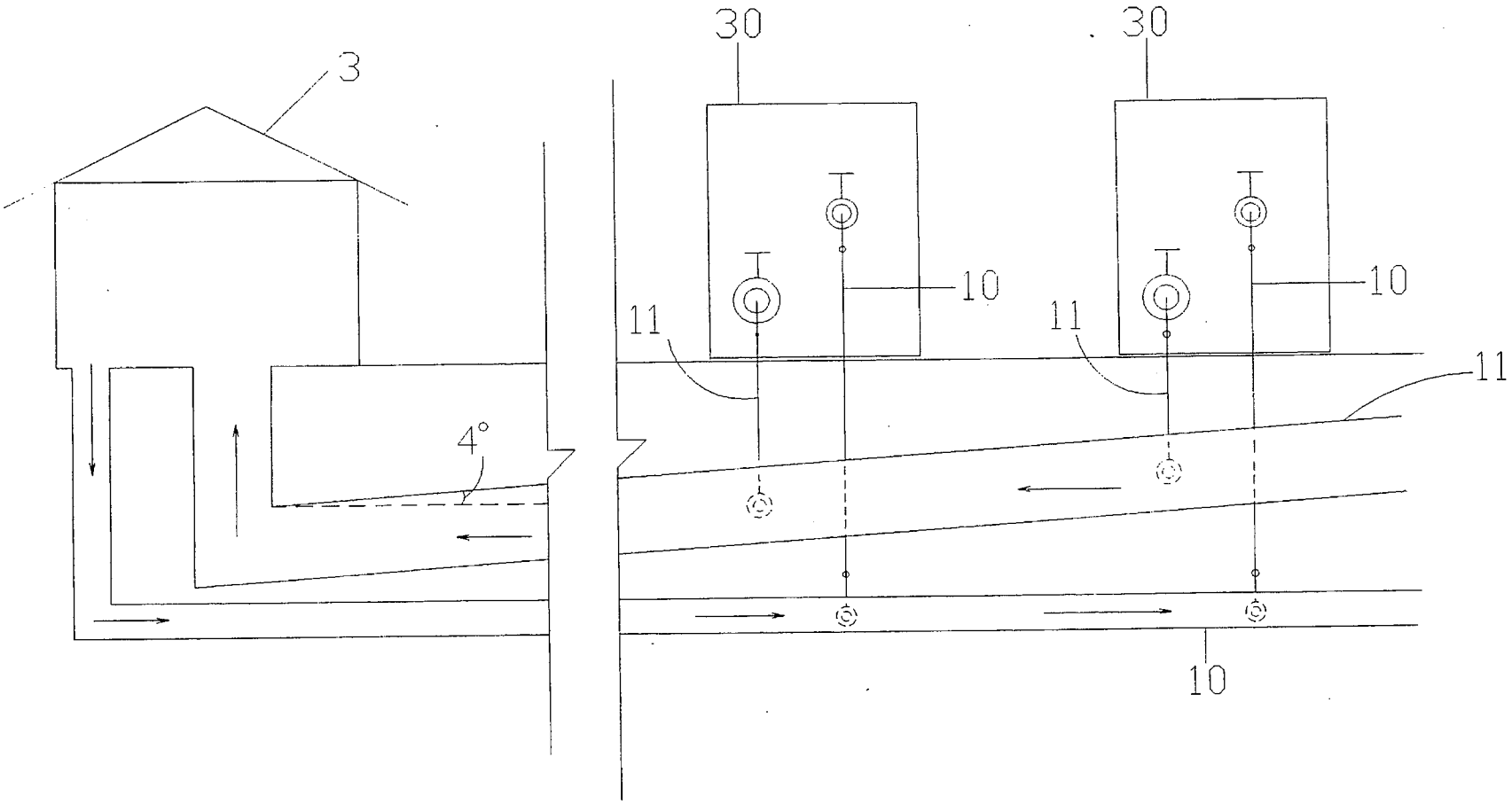
FIG. 4 is a schematic view of the amended air conditioning system of FIG. 2, said figure showing connection of two buildings to the assigned station and showing elevation of a return low-pressure line of refrigerant to the station.

The high-pressure lines 10 of refrigerant from the station 3 and the low-pressure lines 11 of refrigerant to the station 3 are underground and are sized large enough to have the capability of transferring proper air condition loads (i.e. proper quantity of refrigerant) and proper pressures in order to provide maximum amount of air condition needed by each building 30 within a district. The high-pressure lines 10 and the low-pressure lines 11 remain buried until the high-pressure lines 10 and the low-pressure lines 11 protrude above ground and join the solenoid valves 20 and the flow meters 28 assigned to each building 30. The low-pressure lines 11 are positioned underground with a minimal downward slope toward the assigned station 3 in order to allow the refrigerant to gravity flow back to the station 3. The slope is considered with respect to location of the building 30 and the station 3 and is maintained from the ground level of the building 30 to the station 3. As shown in FIG. 4, said low-pressure lines 11 are positioned at an angle of at least approximately 4° (four degrees) to enable the refrigerant, which is a mixture of liquid and gas refrigerant at this stage, to have a natural tendency to flow toward the station 3. Existence of said minimal slope decreases any amount of load on the compressor units 4, assisting the central air condition utility system 1 to operate more efficiently and lowering the cost of pumping refrigerant per each British Thermal Unit (BTU) of cooling provided. In a most preferred embodiment, at intersection of the low-pressure line 11 and the corresponding evaporator 22, the concentration of refrigerant in liquid form is approximately forty percent (40%) and in gas form is approximately sixty percent (60%).

In a most preferred embodiment, line material of pipes used for circulating refrigerant consists of steel casing. Any necessary wall thickness and corrosion protection may be used. The diameter of Schedule 40 seamless wrought steel pipes used for main high-pressure lines 10 ranges from approximately ten inches (10") to approximately sixteen inches (16"). Said Schedule 40 seamless wrought steel pipes of main high-pressure lines 10 of approximately 10-inch diameter have an inner diameter (ID) of approximately 10.020 inches, an outer diameter (OD) of approximately 10.750 inches and a wall thickness ranging from approximately 0.165 inches to approximately 0.565 inches (i.e. 0.365±0.2000). The Schedule 40 seamless wrought steel pipes of main-high pressure lines 10 of approximately 16-inch diameter have an inner diameter of approximately 15.000 inches, an outer diameter of approximately 16.000 inches and a wall thickness ranging from approximately 0.300 inches to approximately 0.700 inches (i.e. 0.500±0.2000). The diameter of Schedule 40 seamless steel pipes of low-pressure lines 11 ranges from approximately eighteen inches (18") to approximately thirty-two inches (32"). Said Schedule 40 seamless steel pipes of low-pressure lines 11 of approximately 18-inch diameter have an inner diameter (ID) of approximately 16.876 inches, an outer diameter (OD) of approximately 18.000 inches and a wall thickness ranging from approximately 0.312 inches to approximately 0.812 inches (i.e. 0.562±0.2500). The Schedule 40 seamless steel pipes of low-pressure lines 11 of approximately 32-inch diameter have an inner diameter of approximately 30.624 inches, an outer diameter of approximately 32.000 inches and a wall thickness ranging from approximately 0.438 inches to approximately 0.938 inches (i.e. 0.688±0.2500).

All joints of pipes are welded together and x-rayed to detect welding faults. The pipes used for the high-pressure lines 10 and for the low-pressure lines 11 are then tested for leaks with nitrogen for a forty-eight hour period. In said tests, nitrogen is provided at a pressure equivalent to five times the operating pressure. The pressure is maintained without adding any more nitrogen to the central air condition utility system 1.

In order to maintain correct high pressures and low pressures, pressure devices are located on and are used to monitor pressures on the high-pressure lines 10 and on the low-pressure lines 11. In order to determine proper pressures (referred to as predetermined pressures) and to detect sudden changes in pressure yielding new pressures, a number of pressure devices is multiplexed together and signals sent to the connected station 3. The station 3 determines the location of change by comparing each new pressure at the location with its pre-determined pressure measured by the pressure device at that same location. All pressure devices are coded with an identification number.

Each station 3 is required to provide all functions needed to provide and maintain air condition utility for each building 30. Each station 3 repeatedly circulates, in a closed loop, refrigerant from the station 3 to the buildings 30 and back to the station 3. In addition, each station 3 is responsible for maintaining required high pressures in the high-pressure lines 10 of refrigerant and required low pressures in the low-pressure lines 11 of refrigerant, monitoring the central air condition utility system 1 and monitoring the high-pressure lines 10 and the low-pressure lines 11. Provision of a maintenance crew for handling any problems and repairs, including the maintenance of the central air condition utility system 1 from the station 3 up to the flow meter 28 for each building 30, would be the responsibility of the air conditioning utility company.

Each station 3 also prepares billing information for each assigned building 30. Monitoring of the demand by each building 30 for cooling is measured by using a timer to record the length of time during which refrigerant is circulated, a flow meter 28 to measure flow rate of the refrigerant that has been circulated in the building 30 and a pressure device to determine the correct pressure of the refrigerant that has been circulated in the building 30. These measurements, along with the identification number of each building 30, are encoded, multiplexed and transmitted back to the station 3 through multiple channels and are input into a computer for providing bills of buildings 30.

Similar to distribution of sources of electricity by the lighting and power utility company in an area, the locations of stations 3 of the central air condition utility system 1 are based upon air condition loads and concentrations of buildings 30 in each area being served. The stations 3 of the central air condition utility system 1 are duplications of one another and are interconnected in order to support each other upon loss of capacity by any stations 3 in maintaining proper pressures and, thus, to minimize loss of required output. The stations 3 operate under the Environmental Protection Agency (EPA) Federal and State guidelines.

Each station 3 replaces and performs the function of the self-contained condensing units, circulating compressed high-pressure refrigerant to and low-pressured refrigerant from amended air conditioning systems 12 of individual buildings 30. There is, however, a major difference between the self-contained condensing units and the station 3 of the central air condition utility system 1. The quantity of buildings 30 that are served by the station 3 of the central air condition utility system 1 is substantially greater than the quantity of buildings 30 that are served by the self-contained condensing unit. One station 3 of the central air condition utility system 1 is capable of satisfying air conditioning needs of a number of amended air conditioning systems 12 of buildings 30 in an entire populated area, resulting in an efficient system that would cut costs of air conditioning substantially.

Certain objects are set forth above and made apparent from the foregoing description, drawings and examples. However, since certain changes may be made in the above description, drawings and examples without departing from the scope of the invention, it is intended that all matters contained in the foregoing description, drawings and examples shall be interpreted as illustrative only of the principles of the invention and not in a limiting sense. With respect to the above description and examples then, it is to be realized that any descriptions, drawings and examples deemed readily apparent and obvious to one skilled in the art and all equivalent relationships to those stated in the examples and described in the specification or illustrated in the drawings are intended to be encompassed by the present invention.

Further, since numerous modifications and changes will readily occur to those skilled in the art, it is not desired to limit the invention to the exact construction and operation shown and described, and accordingly, all suitable modifications and equivalents may be resorted to, falling within the scope of the invention. It is also to be understood that the following claims are intended to cover all of the generic and specific features of the invention herein described, and all statements of the scope of the invention which, as a matter of language, might be said to fall therebetween.

What is claimed as invention is:

1. A system for providing air condition utility to sets of buildings, said system comprising:

(a) a number of stations, with each station being assigned to a district, providing air condition to the buildings in the district and having:

i. an inlet manifold which allows the station to have a single input of a refrigerant, ii. an outlet manifold which allows the station to have a single output of the refrigerant, and iii. a number of compressor units being connected to the inlet manifold and to the outlet manifold and transferring the refrigerant from the inlet manifold to the outlet manifold, with some compressor units set up on line and any remaining compressor units kept in reserve, with shut-off valves, along with control sensors, being used to allow isolation of the station from other stations and to allow connection of the station to other stations;

(b) high-pressure lines distributing the refrigerant from the station of the assigned district to the buildings served by the station;

(c) low-pressure lines returning the refrigerant from the buildings served by the station to the station; and (d) a number of amended air conditioning systems of each building being connected, via the building and upon removal of self-contained condensing units of any previous air conditioning systems of the building, to the station through the high-pressure lines and through the low-pressure lines;

such that the high-pressure lines and the low-pressure lines of the district form a closed loop which connects the buildings of the district to the assigned station.

2. The system for providing air condition utility to sets of buildings according to claim 1, wherein R22 monochlorodifluoromethane ($CHCLF_2$) is used as the refrigerant that is circulated through the high-pressure lines and the low-pressure lines.

3. The system for providing air condition utility to sets of buildings according to claim 1, wherein the refrigerant is provided by the high-pressure lines to each building at a pressure in the range of approximately 275 Pounds Per Square Inch Gauge (PSIG) to approximately 300 PSIG.

4. The system for providing air condition utility to sets of buildings according to claim 1, wherein the refrigerant has a pressure in the range of approximately 65 Pounds Per Square Inch Gauge (PSIG) to approximately 75 PSIG when leaving each building through the low-pressure lines.

5. The system for providing air condition utility to sets of buildings according to claim 1, wherein, at interface of each building, a pressure difference of at least about 197 Pounds Per Square Inch Gauge (PSIG) exists between the pressure of the high-pressure lines of the refrigerant and the pressure of the low-pressure lines of the refrigerant.

6. The system for providing air condition utility to sets of buildings according to claim 1, wherein a portion of the high-pressure line of the refrigerant splits into several branches, such that each branch provides high-pressure line of refrigerant to one assigned building despite the number of amended air conditioning systems that are served in each building and such that, upon exit of each branch from the assigned building, the branches join one another at an identical portion of the low-pressure line.

7. The system for providing air condition utility to sets of buildings according to claim 1, wherein a portion of the high-pressure line of the refrigerant moves, without being split into branches, towards one assigned building only and wherein the low-pressure line of the refrigerant of the assigned building leaves the assigned building to join a portion of the low-pressure line that is not shared by any other building.

8. The system for providing air condition utility to sets of buildings according to claim 1, wherein a portion of the high-pressure line of the refrigerant flows directly from the station of the assigned district and wherein a portion of the low-pressure line of the refrigerant flows directly to the station of the district.

9. The system for providing air condition utility to sets of buildings according to claim 1, wherein repeating divisions of each high-pressure line of the refrigerant in the district result in decreasing line capacities in the divided high-pressure lines and wherein repeating combinations of sets of low-pressure lines yield increasing capacities in the combined low-pressure lines.

10. The system for providing air condition utility to sets of buildings according to claim 1, wherein each station has an air conditioning capacity based upon the air conditioning load that is needed in the buildings of the district, with air conditioning capacity including needs of any additional buildings that could be accepted by the district and of any potential increases in population of the district and, in addition, with a potential growth of approximately twenty-five percent being allowed in air conditioning capacity for the district.

11. The system for providing air condition utility to sets of buildings according to claim 1, wherein the high-pressure lines from the station and the low-pressure lines to the station are substantially underground until the high-pressure lines and the low-pressure lines protrude above ground and join a solenoid valve and a flow meter assigned to each building.

12. The system for providing air condition utility to sets of buildings according to claim 11, wherein the low-pressure lines are positioned underground with a minimal downward slope of approximately 4° (four degrees), considered with respect to location of building and location of the assigned station and maintained from ground level of the building to the station, in order to enable the refrigerant which is a mixture of liquid and gas when leaving the buildings to gravity flow toward the assigned station.

13. The system for providing air condition utility to sets of buildings according to claim 1, wherein, at intersection of the low-pressure line and a corresponding evaporator, the concentration of refrigerant in liquid form is approximately forty percent (40%) and in gas form is approximately sixty percent (60%).

14. The system for providing air condition utility to sets of buildings according to claim 1, wherein line material of pipes used for circulating refrigerant consists of steel casing.

15. A method for providing air condition to a set of buildings without using any self-contained condensing units, said method comprising the following steps:

(a) removal of self-contained condensing units of presently-used air conditioning systems in order to provide amended air conditioning systems;

(b) establishment of a connection between a station that is assigned to a district and each building that is in the district and that is served by the station, with each building having a number of amended air conditioning systems;

(c) transfer of refrigerant in liquid form through high-pressure lines from the station to the buildings, in the district, that are assigned to the station;

(d) upon indication of a demand for cooling by a thermostat of the amended air conditioning system of a building, opening of a solenoid valve assigned to the building due to provision of power to a solenoid relay coil of the amended air conditioning system of the building and, as a result, flow of an amount of high-pressure liquid refrigerant from the station through the solenoid valve, through a flow meter and then through the thermostatic expansion valve of the building into an assigned evaporator of the building;

(e) forcing of air by a fan motor, due to closure of a fan relay resulting from changes in the thermostat, through a fan across the evaporator until the temperature set on the thermostat is reached and a demand for cooling no longer exists, resulting in switch of power from the solenoid relay coil by the thermostat, return of the solenoid valve to the closed position and termination of flow of the refrigerant through the evaporator;

(f) return of the refrigerant, with the high-pressure liquid refrigerant having undergone a drop in pressure in the evaporator and having changed to a partial-liquid partial-gas refrigerant, through low-pressure lines from the building to the assigned station; and (g) transfer of the refrigerant through a number of compressors at the station from an inlet manifold for any low-pressure lines that are directly connected to the station to an outlet manifold for any high-pressure lines that are directly connected to the station, with the refrigerant, that enters the station at a partial-liquid partial-gas stage, exiting the station as a pressurized liquid refrigerant;

such that any quantity of refrigerant that is needed by the district is repeatedly circulated in a closed loop through the high-pressure lines and through the low-pressure lines.

16. The method for providing air condition to a set of buildings without using any self-contained condensing units according to claim 15, upon application of which the voltage of the thermostat, said voltage resulting in opening of the solenoid valves and allowance of the flow of refrigerant through the thermostatic expansion valve, ranges from approximately 24 vac to approximately 32 vac.

17. The method for providing air condition to a set of buildings without using any self-contained condensing units according to claim 15, upon application of which billing information for amount of cooling required by each building and served by the assigned station is provided by using a timer to record length of time during which the refrigerant has been circulated to and from each building, the flow meter to measure the flow rate of the refrigerant that has been circulated in the building and a pressure device to determine the correct pressure of the refrigerant that has been circulated in the building.

* * * * *